US005901582A

United States Patent [19]

Hennig et al.

[11] Patent Number: 5,901,582

[45] Date of Patent: May 11, 1999

[54] KNITTING TOOL HAVING LUBRICANT POCKETS

[75] Inventors: Uwe Hennig, Burladingen; Klaus Wagner, Albstadt; Bernhard Schuler, Sonnenbühl; Hans Lebherz, Bitz; Siegfried Wissmann, Albstadt-Pfeffingen; Albert Teufel, Veringenstadt; Thomas Bregel, Strassberg, all of Germany

[73] Assignee: Groz-Beckert KG, Albstadt, Germany

[21] Appl. No.: 08/798,161

[22] Filed: Feb. 10, 1997

[30] Foreign Application Priority Data

Feb. 10, 1996 [DE] Germany ..... 196 04 954

[51] Int. Cl.[6] ..... D04B 35/02

[52] U.S. Cl. ..... 66/123

[58] Field of Search ..... 66/123, 120, 121, 66/124; 163/2, 3

[56] References Cited

U.S. PATENT DOCUMENTS

| | | | |
|---|---|---|---|
| 410,858 | 9/1889 | Scott | 66/123 |
| 664,808 | 12/1900 | Dodge | 66/123 |
| 2,677,257 | 5/1954 | Jarvis | 66/124 |
| 3,327,498 | 6/1967 | Matthews | 66/123 |
| 3,949,572 | 4/1976 | Kopal et al. . | |
| 4,036,036 | 7/1977 | Ashmead et al. . | |
| 4,417,454 | 11/1983 | Berentzem | 66/123 |
| 4,625,527 | 12/1986 | Fukuhara . | |
| 4,681,150 | 7/1987 | Fukuhara | 163/5 |
| 4,831,847 | 5/1989 | Kawase et al. | 66/123 |

FOREIGN PATENT DOCUMENTS

| | | |
|---|---|---|
| 38 14 884 | 11/1988 | Germany . |
| 5-195394 | 3/1993 | Japan . |

*Primary Examiner*—Andy Falik
*Attorney, Agent, or Firm*—Venable; Gabor J. Kelemen

[57] ABSTRACT

A stamped knitting tool, such as a latch needle, has, on its shank, a lubricant distributing arrangement formed on at least one of the opposite broad shank faces for collecting a lubricant therein during operation of the knitting tool. The lubricant distributing arrangement is constituted by a region of reduced shank thickness extending transversely to the shank length from a distance from the upper shank edge at least substantially to the lower shank edge. The region of reduced shank thickness may be a chamfer, a recess or a depression.

14 Claims, 3 Drawing Sheets

III
III

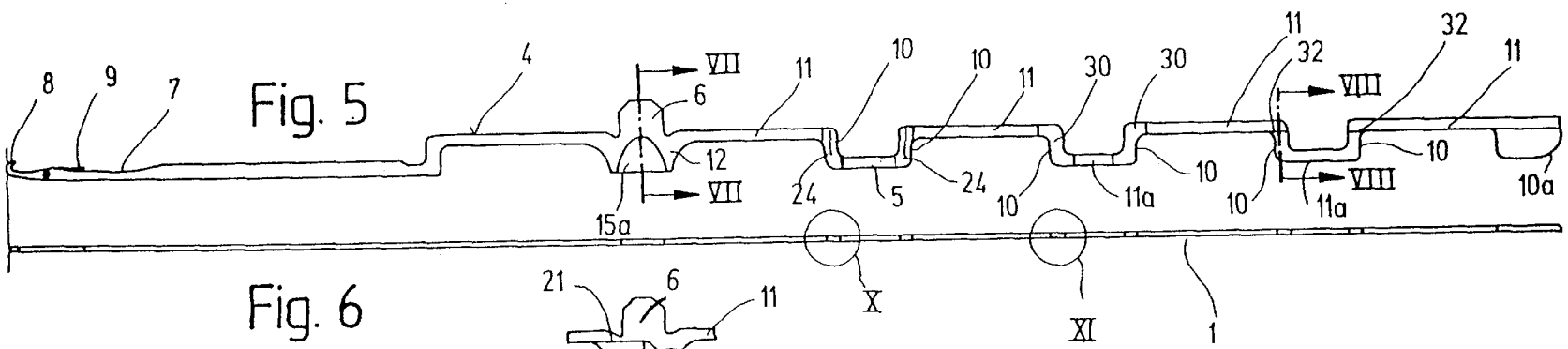
Fig. 5
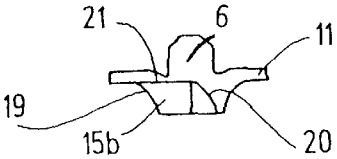
Fig. 6
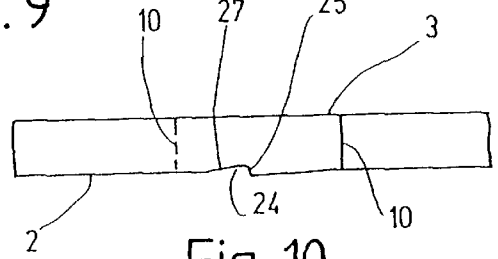
Fig. 9
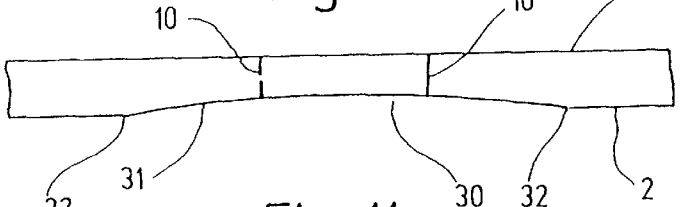
Fig. 10
Fig. 11
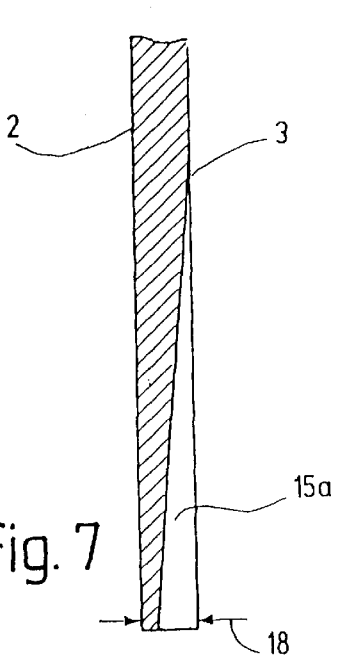
Fig. 7
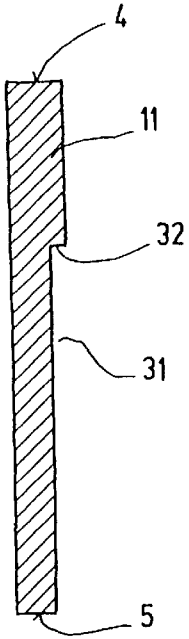
Fig. 8

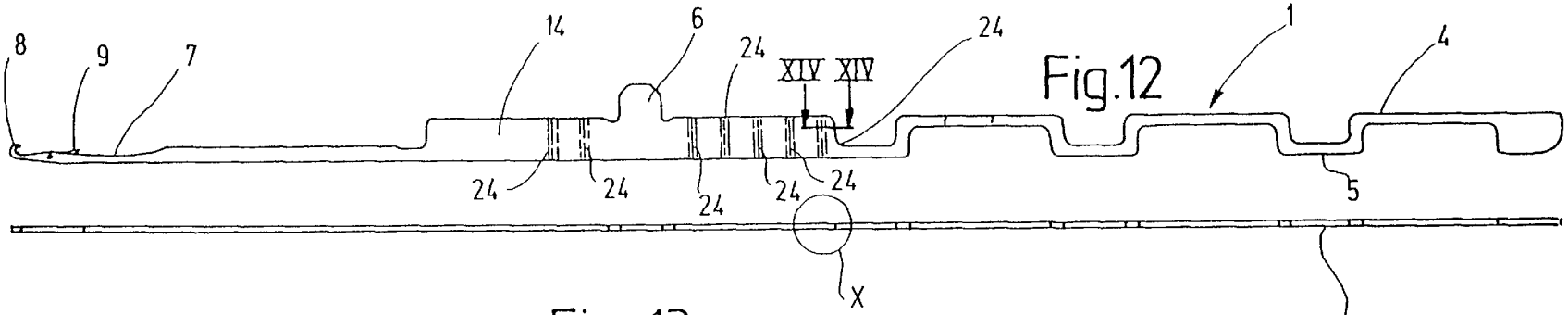
Fig.12
Fig. 13
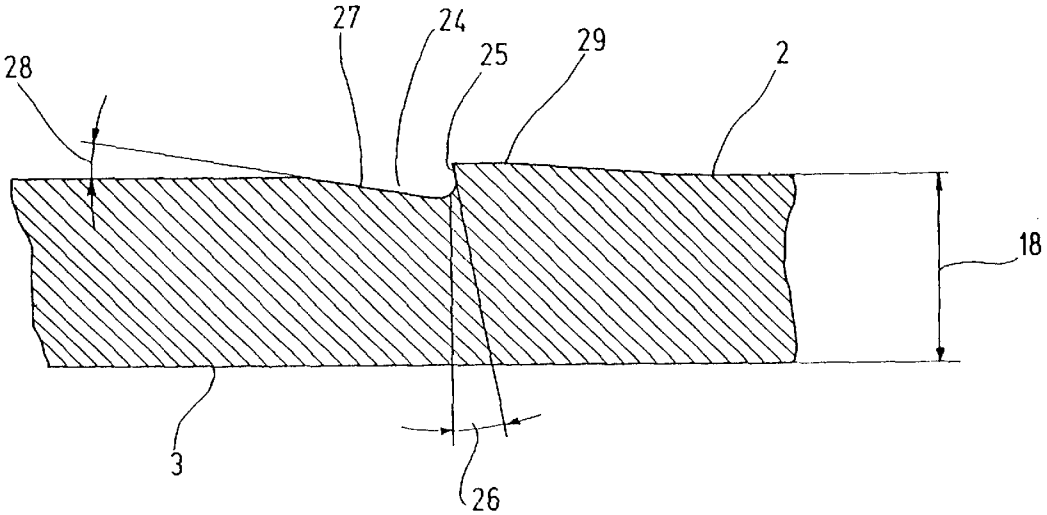
Fig. 14

KNITTING TOOL HAVING LUBRICANT POCKETS

CROSS REFERENCE TO RELATED APPLICATION

This application claims the priority of German Application No. 196 04 954.7 filed Feb. 10, 1996, which is incorporated herein by reference.

BACKGROUND OF THE INVENTION

This invention relates to a stamped knitting tool, such as a hook or latch needle, but may also find application in compound needles, latchless needles such as plush hooks for making plush products, sinkers, buttless needles and the like.

Knitting tools of the above-outlined type have a shank by means of which they are guided for reciprocating motion in an associated guide groove of a needle holder forming part of, for example, a needle bed, a knitting machine dial or a needle cylinder. Since, dependent upon operational conditions, during such a reciprocating motion the needle shank is pressed against the bottom and against at least one of the side walls of the guide groove with a certain force, during operation a significant friction is generated between the needle shank and the contacting wall regions of the guide groove. Such a friction leads not only to a heat-up of the machine components, but also to an increase of the resistance to the needle motion. For this reason, the knitting tools have to be lubricated for which, as a rule, low-viscosity oil is used which is applied as a mist or in drops to discrete lubricating locations in the guide groove. Particularly in rapidly operating knitting machines the thus-obtainable lubricating conditions are often unsatisfactory, and thus, for example, an impermissible heat-up of the machine and the knitting tool may occur, together with an undesired, adverse effect on the service life of the knitting tool or other machine components.

In an effort to remedy the above-discussed disadvantages, Japanese patent document JP-A-5-195394 discloses a latch needle whose shank has two vertical guide pieces extending from the upper shank edge to the lower shank edge and a bridge formed of a narrow web interconnecting the guide pieces. Between the bridge and the needle butt a depression is provided in the needle shank. Such a depression is bordered by the frontal edge of the butt, a narrow connecting web along the lower shank edge and an adjoining guide piece of the bridge. The depression which is open towards the upper shank edge is, during operation, maintained filled with lubricating oil by means of an oil supplying device. During the reciprocating motion of the needle shank, the oil is to be applied to the regions of the guide groove wall over which the oil-containing depression passes. It has been found in practice, however, that particularly in case of small-tolerance guide grooves, the lubricating oil introduced into the depression is compressed during the motion of the needle shank similarly to a piston/cylinder operation. As a result, an increased liquid friction is generated which leads to an appreciable heating of the needle and the needle bed.

Further, according to U.S. Pat. No. 4,625,527, the needle shank is provided at least on one of its two opposite broad sides with a longitudinal groove which extends throughout the entire shank length and which is parallel to the upper and lower shank edges. Such an arrangement is used in particular in latch needles whose shank has at least one bridge of the above-outlined type, that is, the shank has a meandering shape. The longitudinal groove is intended to contribute to an improved lubricant distribution and retention of the lubricant in the guide groove. The effect of such a longitudinal groove for such a purpose is, however, limited because the oil distribution achieved by the longitudinal groove does not result in a sufficient lubrication. Also, the longitudinal groove has the particular purpose of reducing the weight and thus the inert mass of the needle shank to counteract in this manner any tendency to hook breakage which may be caused by shock waves generated as the needle butt strikes the adjoining lock components.

A similar purpose is served by the measure disclosed in U.S. Pat. No. 4,036,036, according to which at least one throughgoing aperture is provided in the needle shank. The aperture which is so arranged that it does not extend up to the upper or lower shank edge serves the purpose to dampen the effect of the shock waves.

U.S. Pat. No. 3,949,572 discloses measures for a circular knitting machine to counteract the impact stresses exerted on the needle by the thread and/or by the inert needle mass. According to this patent a recess is provided in each lateral wall of the guide groove in the region of the needle butt. Such recesses result in an increased play between the needle shank and the butt on the one hand and the facing lateral walls of the guide groove, on the other hand. By virtue of the fact that in the entire butt region of the needle—in which the lateral operational pressing forces with which the needle shank is dressed against the adjoining lateral walls of the guide groove reach their maximum value—no large-surface contact between the needle shank and the side wall of the guide groove takes place, the friction between the needle and the side wall of the guide groove should be reduced. To achieve such a result, because of the length of the needle stroke, relatively long recesses have to be provided in the side walls of the guide grooves, while according to another alternative, the needle shank, including the needle butt, is reduced in its thickness throughout a relatively long throughgoing region which includes a significant part of the needle shank (formed as a full shank) in front of and behind the needle butt. If, however, the butt thickness is reduced, the stability of the butt is adversely affected while, at the same time, the surface stresses appearing at the butt increase at the engagement edges with the locking components. The above-noted U.S. Pat. No. 3,949,572 does not address the problem of lubricating the needle in the guide channel.

SUMMARY OF THE INVENTION

It is an object of the invention to provide an improved knitting tool of the above-outlined type which has a significantly reduced resistance to its motion during reciprocation in the guide channel of a holder and thus contributes to the reduction of the heating and the required driving output while, at the same time, the service life of the knitting tool and the contacting parts of the guide channel are extended.

This object and others to become apparent as the specification progresses, are accomplished by the invention, according to which, briefly stated, the stamped knitting tool has, on its shank, a lubricant distributing arrangement formed on at least one of the opposite broad shank faces for collecting a lubricant therein during operation of the knitting tool. The lubricant distributing arrangement is constituted by a region of reduced shank thickness extending transversely to the shank length from a distance from the upper shank edge at least substantially to the lower shank edge. The region of reduced shank thickness may be a chamfer, a recess or a depression.

Thus, according to the invention, the shank is, at least on one of its large (broad) sides provided with lubricant distributing means which have at least one region of reduced shank thickness. Such a region may be formed by a chamfer extending transversely to the shank length from a location spaced from the upper shank edge to or almost to the lower shank edge. In the alternative or additionally, a region of reduced shank thickness may be formed as a depression which extends transversely to the shank length to or almost to the lower shank edge and which has a substantially wedge or dish-shaped (pan-shaped) cross-sectional configuration and thus has essentially the configuration of a notch or a groove. The region of reduced shank thickness which extends from a location spaced from the upper shank edge to the lower shank edge (or almost thereto) forms a lubricant receiving or collecting pocket from which, during reciprocation of the knitting tool, lubricant is uniformly applied to the bottom and the adjoining lateral walls of the guide channel. In a knitting tool, for example, a latch needle, having a butt arranged at the upper shank edge, the region of reduced shank thickness is arranged expediently underneath the butt which has the same thickness as the shank. In this manner, lubrication is enhanced and improved precisely in that region underneath the needle butt where the shank is pressed with the greatest force against the adjoining lateral wall of the guide channel while, at the same time, a reduction of thickness of the butt and thus a diminishing of its wear resistance are prevented.

In addition, in front of and behind the needle butt cross-sectionally substantially wedge or dish-shaped, notch or groove-like depressions may be provided in the shank. The depressions extend transversely to the shank length and effectively reduce the lubricant outflow from the region underneath the needle butt. Such an arrangement is of particular significance, for example, in case of cylinder needles of circular knitting machines where, because of their vertical operating position, the lubricant introduced into the guide channels tends to flow downwardly by gravity. In case no additional measures are taken, such an occurrence results in an insufficient lubricant supply to the most stressed locations.

The shank may have a zone of increased shank thickness adjoining the above-discussed depressions, whereby a raised sealing lip is provided on the respective side of the depression. The sealing lip improves the sealing of the thus-formed lubricant-collecting pocket against the facing side wall of the guide channel.

In addition to the above-noted improved lubricant retention in the guide groove and along the shank, the regions of reduced shank thickness effect a reduction of the contacting area with the adjoining lateral wall of the guide groove at the respective broad side of the shank. In this manner, together with the improved lubrication, a significant reduction of friction between the knitting tool and the cooperating walls of the associated guide groove is obtained. As result, the resistance of the knitting tool motion which is to be overcome by the drive is significantly reduced. The improved lubricating conditions furthermore lead to an extended service life of the knitting tool itself as well as the guide elements associated therewith.

BRIEF DESCRIPTION OF THE DRAWINGS

FIG. 5 is a side elevational view of a knitting tool (latch needle) of another preferred embodiment.

FIG. 6 is a top plan view of the embodiment shown in FIG. 5.

FIG. 7 is an enlarged sectional view taken along line VII—VII of FIG. 5.

FIG. 8 is an enlarged sectional view taken along line VIII—VIII of FIG. 5.

FIG. 9 is a fragmentary side elevational view of a variant of a butt region of a latch needle shown in FIG. 5.

FIG. 10 is an enlarged top plan view of the inset X of FIG. 6.

FIG. 11 is an enlarged top plan view of the inset XI of FIG. 6.

FIG. 12 is a side elevational view of a latch needle according to another preferred embodiment of the invention.

FIG. 13 is a top plan view of the construction shown in FIG. 12.

FIG. 14 is an enlarged fragmentary sectional view taken along line XIV—XIV of FIG. 12 at a location designated at X in FIG. 13.

DESCRIPTION OF THE PREFERRED EMBODIMENTS

Figures 1, 2, 3, 4:
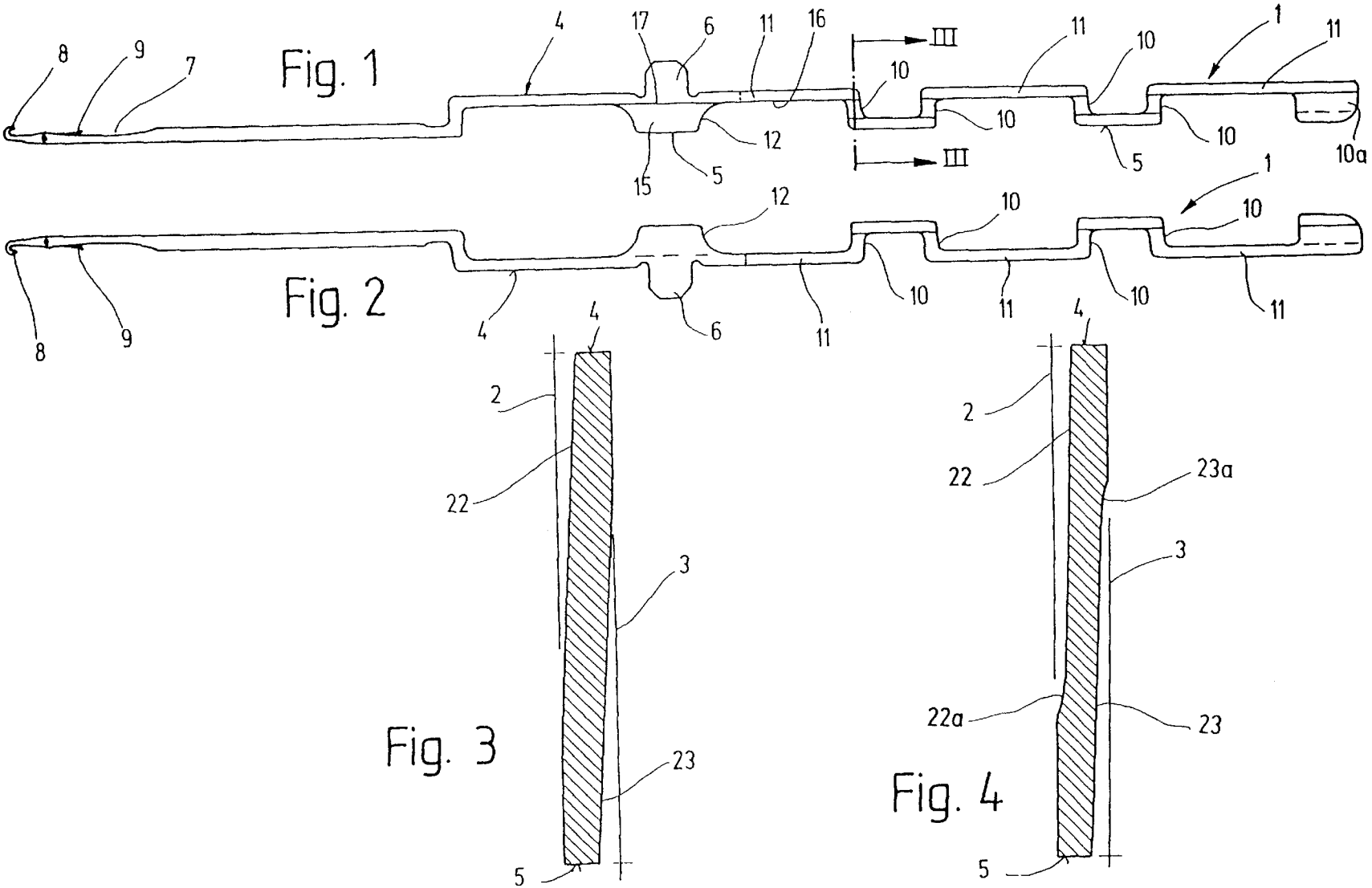
FIG. 1 is a side elevational view of a knitting tool (latch needle) according to a preferred embodiment of the invention.
FIG. 2 is a side elevational view from the side opposite to that of FIG. 1.
FIG. 3 is an enlarged sectional view taken along line III—III of FIG. 1.
FIG. 4 is an enlarged sectional view taken at a location along line III—III of FIG. 1, illustrating a variant.

The three embodiments of the invention disclosed below and illustrated in side elevation in FIGS. 1, 5 and 12 are latch needles stamped from a steel ribbon. Each latch needle has a needle shank 1 of rectangular cross-sectional outline, opposite large (broad) sides designated at 2 and 3 in FIGS. 3 and 4 as well as upper and lower shank edges designated at 4 and 5, respectively. A butt 5 is provided on the upper shank edge 4 of the shank 1. At an end of the shank 1, preceded by a groove 7, a needle hook 8 is provided which cooperates in a known manner with a pivotally supported needle latch 9. As may be seen in FIGS. 1, 2, 5 and 12, the shank 1 has in all embodiments a plurality of bridges distributed at least along a length portion of the shank 1. Each bridge is formed of two vertical guide pieces 10 extending perpendicularly to the shank length from the upper shank edge 4 to the lower shank edge 5 and a narrow web 11 which connects the guide pieces 10 with one another and which extends parallel to the upper and lower shank edges 4 and 5. In the region of the bridges the shank 1 thus has a meandering configuration. In the embodiments according to FIGS. 1, 2 and 5, 6, underneath the butt 6 a similar, although wider guide piece 12 is provided which is in alignment with the lower shank edge 5, that is, it extends to the needle back.

In the embodiment according to FIGS. 12 and 13, in the region of the butt 6 the shank 1 is formed as a full (solid) shank. The full-shank portion 14 extends over an approximately identical length on either side of the needle butt 6 and has the full needle shank height.

In each embodiment the needle shank 1 is provided, at least on one of its large sides 2 and 3, with lubricant distributing means which have the purpose of reducing the friction between the side walls of a non-illustrated guide channel of the needle bed and the needle shank 1 and of improving the lubricating conditions for the latch needle in the needle channel during the reciprocation of the latch needle in the guide channel. As a result, the heat generated in the knitting machine during operation is reduced and further, an extended service life of the latch needles is obtained. Each lubricant distributing means includes at least one region of reduced shank thickness on one of the two broad sides 2 and 3 of the shank 1 to ensure a retention and distribution of the lubricant and at the same time, to reduce the effective contact surface with the facing guide channel side walls. This results in a reduction of the resistance to the needle motion during operation.

In the two embodiments according to FIGS. 1, 2 and 5, 6, respectively, the region of reduced shank thickness is situated below the butt 6 which has the same thickness as the shank 1. Thus, in the embodiment according to FIGS. 1 and 2 the shank 1 is, in the region of the guide portion 12 underneath the butt 6 on the broad face 2, provided with a recess 15 formed as a flattened portion extending over the length of the guide portion 12. The recess 15 continuously extends from a line 17 which represents the continuation of the lower edge 16 of the web 11 adjoining the butt 6 on either side, to the level of the lower shank edge 5. The needle shank has, throughout the surface of the recess 15, a uniform reduced thickness which is approximately between 10 to 50% of the normal shank thickness. In the alternative, the region of reduced shank thickness at 15 may be constituted by a chamfer which, starting from the line 17 shown in FIG. 1 extends to the lower shank edge 5 in such a manner that the needle shank 1 has a substantially wedge-shaped sectional configuration in the region 15 as shown in FIG. 7 for the latch needle embodiment illustrated in FIGS. 5 and 6 which will be discussed in more detail below.

In the embodiment according to FIGS. 5 and 6, the region 15*a* of reduced shank thickness situated under the butt 6 is a chamfer or recess which extends to the lower shank edge and is approximately of parabola shape whose apex is oriented towards the butt 6 as seen in FIG. 5. The cross-sectional illustration in FIG. 7 shows that the region 15*a* of parabolic outline reduces the shank thickness from the normal value which corresponds to the thickness of the butt 6 in the vicinity of the apex of the parabola down to a minimum value at the lower shank edge 5 which is approximately 25% of the normal shank thickness designated at 18. In the alternative, the chamfer forming the region 15*a* may be replaced by a stepped recess so that in principle a cross-sectional configuration as shown in FIG. 8 is obtained where the region 15*a* of reduced shank thickness is constant. Instead of a parabola, the outline of the region 15*a* may be, for example, circular or triangular.

A further alternative of the configuration of a region 15*b* of reduced cross section is illustrated in FIG. 9. A recess forming the region 15*b* may have a cross-sectional shape that corresponds to that shown in FIG. 7 or FIG. 8. The recess is open at its side 19 which is oriented towards the needle hook 8, while on its side 20 situated behind the butt 6 it is bordered by an arcuate wall face which continues on the top side in a portion 21 that extends parallel to the lower edge of the adjoining web 11 and corresponds to the line 17 shown in FIG. 1.

Particularly referring to FIG. 3, in the latch needle according to the embodiment illustrated in FIGS. 1 and 2, the vertical guide pieces 10 which are provided on the back shank (that is, on the shank portion which extends from the butt 6 in a direction away from the hook 8) have, on both opposite broad sides 2 and 3, respective chamfers 22 and 23. The chamfer 22 provided on the broad side 2 extends from the upper shank edge 4 over a length of approximately two-thirds of the height of the guide piece 10. On the opposite broad side 3 the chamfer 23 extends from the lower shank edge 5 and has a length which is approximately equal to that of the chamfer 22 so that the two chamfers 22 and 23 are in a mutually overlapping relationship.

Instead of the planar boundary of the two chamfers 22 and 23 shown in FIG. 3, according to an alternative illustrated in FIG. 4, each of the chamfers 22 and 23 may have a respective curved transitional zone 22*a* and 23*a* adjoining the surface of the respective broad side 2 or 3. For some knitting tools it is feasible to provide only one broad side 2 or 3 with a respective chamfer 22 or 23. It is also feasible to provide the chamfers 22 and/or 23 with a cross-sectionally curvilinear bottom.

The last (terminal) guide piece 10*a* may be chamfered in the manner described, so that cross-sectional configurations according to FIG. 3 or FIG. 4 are obtained. It can, however, also be shaped as the earlier-described regions 15 or 15*a* of reduced wall thickness.

In the embodiment of the latch needle illustrated in FIGS. 5 and 6 the guide pieces 10 of two bridges on the back shank are provided on the respective broad side 2 (oriented toward the viewer of FIG. 5) with notch-like depressions 24 which extend from the upper shank edge 4 to the lower shank edge 5 transversely to the shank length and which have a wedge-shaped cross-sectional configuration as best seen in FIGS. 10 and 14. The depressions 24 which, as seen in FIG. 10, extend in the length direction of the needle approximately over one half of the width of the associated guide pieces 10 are bordered by a side wall 25 on the side situated remote from the needle butt 6. The side wall 25 forms an angle of 90° with the plane of the lateral face 2 or, as may be seen in FIG. 14, forms an angle 26 of 10–20° with a line which is perpendicular to the surface 2. By virtue of such a configuration the side wall 25 forms a hollowed-out portion which is adjoined by an oblique bottom surface 27 in the direction of the needle butt 6. The oblique bottom surface 27 forms an acute angle 28 of 5–20°, preferably 10° with the shank surface 2 or runs smoothly into the surface 2.

Turning to FIG. 14, The shank 1 has a cross-sectionally approximately wedge-shaped zone 29 of increased shank thickness which adjoins the depression 24 and which extends the lateral face 25 outwardly and forms, beyond the shank height, a sealing lip whose function will be discussed in detail below.

The two consecutive guide pieces 10 spaced rearwardly from the butt 6 are also provided with regions of reduced shank thickness. In this instance, however, these regions are each formed as trough-like depressions which extend transversely to the shank length, from the upper shank edge 4 to the lower shank edge 5. These depressions have a cross-sectionally arcuately bent configuration, resulting in a pan-like or dish-like shape. The boundary line 31 shown in FIG. 11 may have at its end 32 a smooth transition into the surface of the large shank side 2. The trough or groove-like depression 30 extends, as shown in FIG. 1, beyond the respective piece 10 into the zone of the adjoining web 11 or 11*a'*.

The next guide piece 10 in the direction or the shank end, together with the adjoining web 11*a* situated on the shank back and the consecutive guide piece 10 are provided with a region of reduced thickness by means of a stepped part 31 shown in FIG. 8. This region of reduced thickness extends upwardly approximately to the lower edge 32 of the adjoining webs 11 and extends downwardly to the lower shank edge 5. The terminal guide piece 10*a* too, is provided with a similar flattened zone of reduced shank thickness, shaped as in the embodiment according to FIGS. 1 and 2.

As described above, in the latch needles which have meandering shafts according to the embodiments of FIGS. 1, 2 and 5, 6, the notch-like depressions 24, the groove-shaped depressions 30, as well as the stepped portions 31 or flattened portions 22, 23 at the guide pieces 10 are situated on the back shank (that is, on the side of the needle butt 6 oriented away from the needle hook 8). It is, however, also feasible to provide the described measures both in front of and behind the butt 6 or only in front of the butt 6, that is, between the butt 6 and the needle hook 8, dependent upon the orientation of the needle in the knitting machine, the purpose and the construction of the needle or in general in knitting tools constructed according to the invention. Further, the arrangement of the thus-formed lubricant distributing means is independent from the configuration of the shank of the stamped knitting tool. Stated differently, the depressions 24, 30, the chamfers 15, 15*a* or the recesses 31, etc. may be used in full-shank needles (that is, needles having a generally straight, rather than a meandering back shank), sinkers or buttless needles as used in left/left knitting machines or in knitting machines in which linear motors may be used for the needle drive. The same applies to needle tools whose shank has plastic-filled apertures.

The latch needle embodiment illustrated in FIGS. 12 and 13 has, in the region of the needle butt 6, a full-shank portion 14 in which, on the broad side 2 (oriented towards the observer) parallel-spaced notch-like depressions 24 are provided. Two such depressions are situated in front of and five behind the needle butt 6.

The notch-shaped depressions 24 may be made with chisel-like tools used in the manufacture of files while the recesses or chamfers 15*a* may be milled or pressed. The other, pan-shaped or groove-shaped depressions 30, etc. may be made by milling or embossing. It is further to be understood that in the embodiment according to FIGS. 12, 13 too, a milled-out portion or chamfer 15*a* may be provided below the needle butt 6. It applies in general that in each embodiment regions of reduced shank thickness of the above-described type may be present, if required, on both broad sides 2 and 3 of the needle shank 1.

The regions of reduced shank thickness provided in the needle shank work as oil collecting or oil capturing pockets from which the lubricant introduced into the guide channel is distributed along the motion path of the needle over the bottom wall and the guide channel side walls against which the needle shank as pressed during operation. The chamfers 22, 23 and/or 15, 15*a,* similarly to the recesses 15, 31, provide free spaces which reduce the lubricant resistance and sliding resistance during operation. At the same time, particularly the recesses or chamfers 15, 15*a* arranged below the needle butt function as oil collectors from which lubricant is introduced to the highly stressed locations as well to as the highly stressed front and rear edge of the needle butt. The notch-like depressions 24 contribute to a uniform lubricant distribution and prevent an undesired downward outflow of the lubricant particularly in case the needles operate in a vertical orientation. Such a sealing effect is further enhanced by the sealing lips 26.

It will be understood that the above description of the present invention is susceptible to various modifications, changes and adaptations, and the same are intended to be comprehended within the meaning and range of equivalents of the appended claims.

What is claimed is:

1. A stamped knitting tool comprising (a) a shank having (1) a length;

(2) opposite broad sides;

(3) opposite narrow sides constituted by an upper shank edge and a lower shank edge, respectively; and (4) a shank thickness represented by the distance between the opposite broad sides and a height of shank material represented by the distance between the opposite narrow sides; and (b) lubricant distributing means formed on at least one of said broad sides for collecting a lubricant therein during operation of the knitting tool; said lubricant distributing means comprising a region of reduced shank thickness starting at a distance from said upper shank edge and extending transversely to said length at least substantially to said lower shank edge; any length of said region measured parallel to said height of said shank material being less than said height of said shank material; said region of reduced shank thickness comprising a configuration selected from the group consisting of a chamfer, a recess and a depression.

2. The knitting tool as defined in claim 1, wherein said depression has a wedge-shaped cross-sectional configuration.

3. The knitting tool as defined in claim 1, wherein said depression has a pan-shaped cross-sectional configuration.

4. The knitting tool as defined in claim 1, further comprising a butt situated on said upper shank edge; said butt having a thickness equalling said shank thickness; wherein said region of reduced shank thickness is disposed underneath said butt.

5. The knitting tool as defined in claim 4, wherein said region of reduced shank thickness is parabola-shaped having an apex oriented toward said butt.

6. The knitting tool as defined in claim 4, wherein said region of reduced shank thickness is open at least unilaterally in a direction of the shank length.

7. The knitting tool as defined in claim 1, wherein said shank has a region of increased thickness relative to said shank thickness; said region of increased thickness adjoins said depression.

8. The knitting tool as defined in claim 1, wherein said region of reduced shank thickness is formed of chamfers extending on said opposite broad sides of said shank; one of said chamfers extending to said lower shark edge and the other of said chamfers extending substantially to said upper shank edge.

9. The knitting tool as defined in claim 1, wherein said chamfer has a stepped configuration.

10. The knitting tool as defined in claim 1, wherein said recess has a stepped configuration.

11. The knitting tool as defined in claim 1, wherein said region of reduced shank thickness has, at least along a length portion thereof, a cross-sectionally arcuate shape.

12. The knitting tool as defined in claim 1, wherein said shank has a shank height represented by the distance between said upper shank edge and said lower shank edge; further wherein said shank includes a bridge composed of at least two spaced guide pieces extending from said upper shank edge to said lower shank edge and respective webs connecting said guide pieces with one another; said webs having a web height measured parallel to and being less than said shank height; said region of reduced shank thickness being situated on at least one of said guide pieces.

13. The knitting tool as defined in claim 12, wherein said region of reduced shank thickness situated on said one guide piece extends along said shank length into a region of one of said webs.

14. The stamped knitting tool as defined in claim 1, wherein said region is a first region; further comprising a second region of reduced shank thickness extending from said upper shank edge at least substantially to said lower shank edge.

* * * * *